US006560910B1

(12) United States Patent
McLaren

(10) Patent No.: US 6,560,910 B1
(45) Date of Patent: May 13, 2003

(54) GUN LOCK

(76) Inventor: Robert R. McLaren, Betterline Products, Inc., P.O. Box 3842, Fullerton, CA (US) 92834-3842

( * ) Notice: Subject to any disclaimer, the term of this patent is extended or adjusted under 35 U.S.C. 154(b) by 0 days.

(21) Appl. No.: 09/613,484

(22) Filed: Jul. 11, 2000

(51) Int. Cl.[7] ..... F41A 17/04
(52) U.S. Cl. ..... 42/70.11
(58) Field of Search ..... 42/70.01, 70.11

(56) References Cited

U.S. PATENT DOCUMENTS

| | | | | |
|---|---|---|---|---|
| 2,479,107 | A | 8/1949 | Garretson | 42/70.11 |
| 2,887,807 | A | 5/1959 | Santangelo | 42/70.11 |
| 4,398,366 | A | 8/1983 | Wernicki | 42/70.11 |
| 4,512,099 | A | 4/1985 | Mathew | 42/70.11 |
| 4,908,971 | A | 3/1990 | Chaney | 42/70.11 |
| 4,961,277 | A | 10/1990 | Rosenbaum | 42/70.11 |
| 5,048,211 | A | 9/1991 | Hepp | 42/70.11 |
| 5,289,653 | A | 3/1994 | Szebeni et al. | 42/70.11 |
| 5,491,918 | A | 2/1996 | Elmstedt | 42/70.11 |
| 5,664,358 | A | 9/1997 | Haber et al. | 42/70.11 |
| 5,699,687 | A | 12/1997 | Pittman | 42/70.11 |
| 5,860,241 | A | 1/1999 | Waters | 42/70.11 |

*Primary Examiner*—Stephen M. Johnson

(74) *Attorney, Agent, or Firm*—Robert Ryan Morishita Anderson & Morishita

(57) ABSTRACT

A gun locking device includes a tube that fits within the bore of a handgun or other firearm and extends from the muzzle to the chamber. A first or expandable subassembly on the distal end portion of the tube cooperates with a second or actuator subassembly on the proximal end to enable a user to lock the tube within the barrel by operating the actuator assembly to thereby expand the expandable subassembly so that it obstructs removal of the tube from the barrel. The expandable subassembly holds radially moveable balls in a ring within the distal end portion of the tube and in alignment with a ring of radially facing apertures. Operation of an actuator knob on the actuator subassembly causes a compression rod within the tube to cause two compression balls to bear against the radially moveable balls so that the radially moveable balls protrude through the apertures to the chamber wall for locking purposes. A combination lock for locking the actuator knob includes multiple disks adapted to be rotated between a fixed number of disk positions to achieve a predetermined combination of disk positions that enables the user to unlock the actuator knob. Tabs protruding from the periphery of each disk indicate disk position and provide structure the user can bear against in order to rotate the disks between disk positions, while a detent arrangement operates against recesses in a peripheral portion of each disk to provide tactile feedback that facilitates rotation of the disks to desired disk positions in darkness.

16 Claims, 4 Drawing Sheets

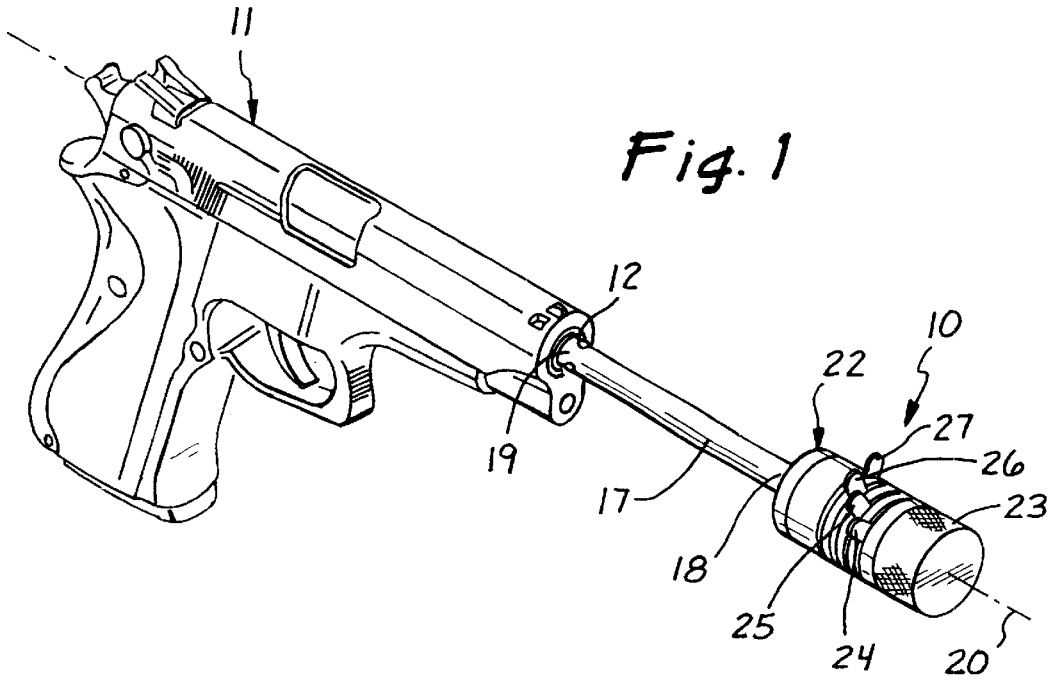
Fig. 1
Fig. 2
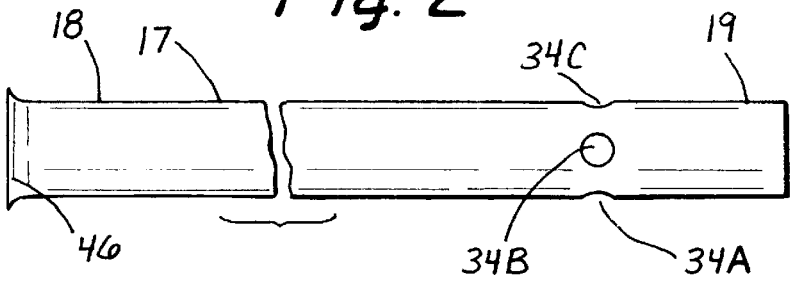
Fig. 3
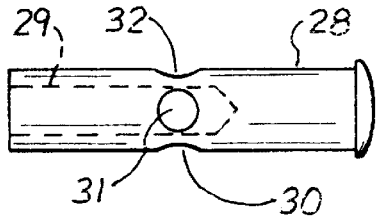

GUN LOCK

BACKGROUND OF THE INVENTION

1. Technical Field

This invention relates generally to locking devices for firearms, and more particularly to a locking device for handguns, rifles, shotguns, and other firearms that prevents unauthorized use without significantly impeding authorized use.

2. Description of Related Art

Some existing handgun locking devices take the form of a "barrel lock." A hollow tube extends coaxially down the bore of the barrel, from a proximal end of the tube at the muzzle to a distal end of the tube at the chamber. A chamber-engaging arrangement at the distal end cooperates with a combination, key, or electronic lock arrangement at the proximal end to prevent unauthorized withdrawal. Once in place, the barrel blocking tube effectively renders the handgun inoperative until removed. The problem is that the right combination of barrel lock attributes to satisfy gun owners remains elusive.

First consider existing chamber-engaging arrangements at the distal end. One existing design requires a separate, dummy cartridge be inserted in the chamber. A spring-biased cam forces locking balls to protrude radially outward through recesses in the distal end of the tube so that the locking balls engage recesses in the dummy cartridge. One problem with doing it that way is that an extra component is required (i.e., the dummy cartridge). Of course, the locking balls can bear directly against the chamber in smaller caliber handguns without using the dummy cartridge, but doing so can mar the chamber wall if ever the barrel lock is rotated within the barrel (e.g., a forced unauthorized removal attempt). The locking balls tend to scrape across the chamber wall without rotating. In addition, a spring is required to force the cam against the locking balls, and springs eventually fail. Furthermore, accommodating the tolerance variations of various gun manufacturers can be more costly with this design. Thus, a better chamber-engaging arrangement is needed at the distal end.

Existing combination, key, or electronic lock arrangements at the proximal end also have certain drawbacks. Existing combination locks in use on barrel locks require the user to view the combination disks. That means the user may have to turn on a light to unlock the handgun. Key locks can be even more difficult. The key may have to be located and used at a very critical time. Electronic locks depend on battery power, and the battery may fail at a critical time. All these things can impede quick access by an authorized user, and so a better lock arrangement is needed at the proximal end.

SUMMARY OF THE INVENTION

This invention alleviates the concerns outlined above by providing a locking device for a firearm (a locking device of the barrel lock type) that includes a better chamber-engaging arrangement and a better combination lock arrangement. Four user-controlled locking balls move radially outward to the chamber wall while remaining free to rotate so that the lock device can swivel without damaging the chamber. Multiple-position combination disks are coupled with a peripheral detent arrangement that enables dialing in the combination by feel without viewing the combination disks.

The illustrated embodiment achieves those things and much more. The locking balls are deployed radially outward toward the chamber wall to a locked configuration without spring action so that there is no spring component to eventually fail. The amount of deployment can be precisely preset for a particular firearm with an integral adjustment screw. The ergonomics of four combination disks and their limited-positions, coupled with a peripheral detent arrangement, provide just the right feel for quick, trouble-free, touch-code operation by an authorized user, even in total darkness.

To paraphrase some of the more precise language appearing in the claims, the locking device is adapted for use with a firearm having a barrel with a muzzle, a bore, and a chamber wall that defines a chamber. The locking device includes a hollow tube adapted to fit coaxially within the bore of the barrel and extend from the muzzle to the chamber. A first or expandable subassembly on the distal end portion of the tube is adapted to be moved under user control between a first configuration that fits within the bore so that the first subassembly does not obstruct removal of the tube from the bore, and a second configuration that fits within the chamber but does not fit within the bore (i.e., it extends too far radially outward to fit) so that the first subassembly does obstruct removal of the tube from the bore.

A second or actuator subassembly on the proximal end of the tube enables a user to selectively move the expandable subassembly between the first and second configurations while the tube is within the bore. The actuator subassembly includes an actuator knob adapted to be rotated manually a partial turn between a first position of the actuator knob corresponding to the first subassembly being in the first configuration, and a second position of the actuator knob corresponding to the first subassembly being in the second configuration. The actuator subassembly also includes means for selectively locking the actuator knob in the second position. A rod disposed coaxially within the tube couples axial movement from the actuator subassembly to the expandable subassembly when the knob is rotated.

According to a major aspect of the invention, the distal end portion of the tube defines first, second, third, and fourth apertures disposed in a ring formation at circumferentially spaced apart locations around a periphery of the distal end portion. The expandable subassembly also includes first, second, third, and fourth radially moveable balls disposed in a ring formation within the distal end portion of the tube. The expandable subassembly is adapted to hold each of the radially moveable balls in alignment with an associated one of the first, second, third, and fourth apertures so that the radially moveable balls are free to rotate and to be moved radially.

The expandable subassembly also includes first and second compression balls within the distal end portion of the tube. The first compression ball is located distally of the radially moveable balls. The second compression ball is located proximally of the radially moveable balls. Both the first and second compression balls are free to rotate, and the first and second compression balls are adapted to bear against and move the radially moveable balls radially outward when the second compression ball is move axially toward the first compression ball.

The actuator subassembly is so adapted that moving the actuator knob from the first position to the second position with the tube in the bore causes the rod to bear against and move the second compression ball axially toward the first compression ball, thereby causing the radially moveable balls to protrude through the first, second, third, and fourth apertures to the chamber wall in order to obstruct removal of the tube from the bore. The actuator subassembly is also so adapted that moving the actuator knob from the second position to the first position causes the rod to retract from the second compression ball so that the radially moveable balls are free to move radially inward sufficiently to not obstruct removal of the tube from the bore.

According to another aspect of the invention, the means for locking the actuator knob facilitates fast operation in total darkness. The actuator knob is mounted on a lock body that is connected to the proximal end of the tube. A locking bar on the lock body moves under user control between an unlocked position of the locking bar in which the locking bar does not obstruct rotation of the actuator knob and a locked position of the locking bar in which the locking bar does obstruct rotation of the actuator knob.

A plurality of disks on the lock body are adapted to be manually rotated only a partial turn. Each of the disks defines a slot such that the slots of all the disks must be aligned by rotating the disks to a predetermined combination of disk positions in order for the locking bar to be moved between the unlocked and locked positions. A detent arrangement on the lock body partially restrains the disks at each disk position.

Each disk includes a tab portion that protrudes radially outward from the rest of the disk as an indication of disk position and as a structure for a user to bear against in order to rotate the disk between disk positions. Each disk includes an outer periphery portion that defines a fixed number of recesses corresponding to an equivalent number of disk positions. The detent arrangement is adapted to cooperate with the recesses in the outer periphery portion of each disk in order to partially restrain the disks at each disk position while providing tactile feedback to the user of movement between disk positions in order to facilitate operation in darkness. The following illustrative drawings and detailed description make the foregoing and other objects, features, and advantages of the invention more apparent.

BRIEF DESCRIPTION OF THE DRAWINGS

FIG. 1 of the drawings is an isometric view of a gun lock constructed according to the invention in position to be inserted into the bore of a handgun barrel;

FIG. 2 is a foreshortened side view of just the tube component showing the locking ball apertures in it;

FIG. 3 is a side view of just the ball plug component showing the locking ball aperture in it;

DESCRIPTION OF THE PREFERRED EMBODIMENTS

Figure 4:
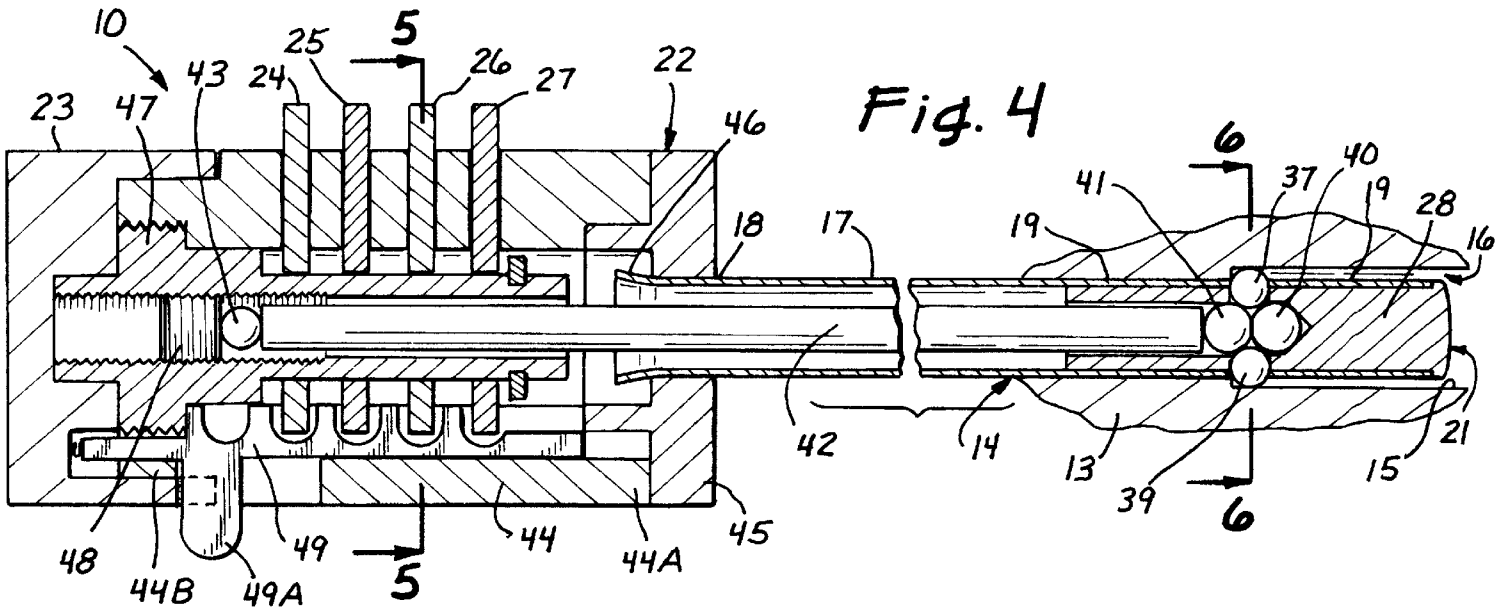
FIG. 4 is an enlarged cross sectional view of the gun lock shown in a locked configuration within the gun barrel and the locking balls within the chamber.
Figure 6:
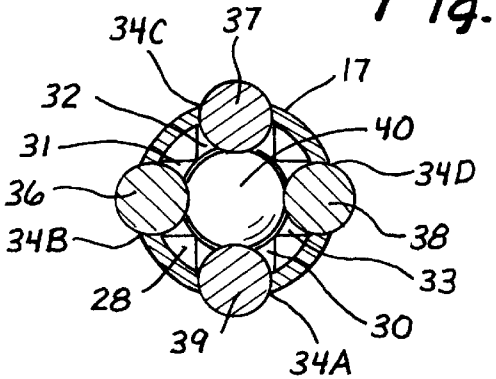
FIG. 6 is a further enlarged cross sectional view of the locking balls in the ball plug component, taken on line 6—6 of FIG. 4 with the gun lock in the locked configuration.

FIGS. 1–11 of the drawings show various aspects of a gun lock 10 constructed according to the invention. Although the illustrated gun lock 10 is described with reference to a .45 caliber, clip fed, semi-automatic handgun 11 shown in FIG. 1, the inventive concepts disclosed and claimed are not so restricted. A gun lock constructed according to the invention can be configured for use with any of various firearms, including semi-automatic handguns, revolvers, and rifles, so long as the firearm has a barrel with a bore and a muzzle, and a chamber wall that defines a chamber. A muzzle 12 of the handgun 11 is designated in FIG. 1, while a barrel 13 and its bore 14 are designated in FIGS. 4 and 7, along with a chamber wall 15 that defines a chamber 16. Those are all well known parts of a handgun.

For the illustrated .45 caliber handgun 11, the bore 14 has a first diameter measuring about 0.443 inches and the chamber 16 has a second diameter measuring about 0.477 inches. Of course, those diameters will be different for different caliber handguns and other firearms. They also may vary for different handguns and other firearms of the same caliber depending on the manufacturer. But the difference in diameter of the bore and the chamber enables the gun lock 10 to lock in place by enlarging radially.

Figure 7:
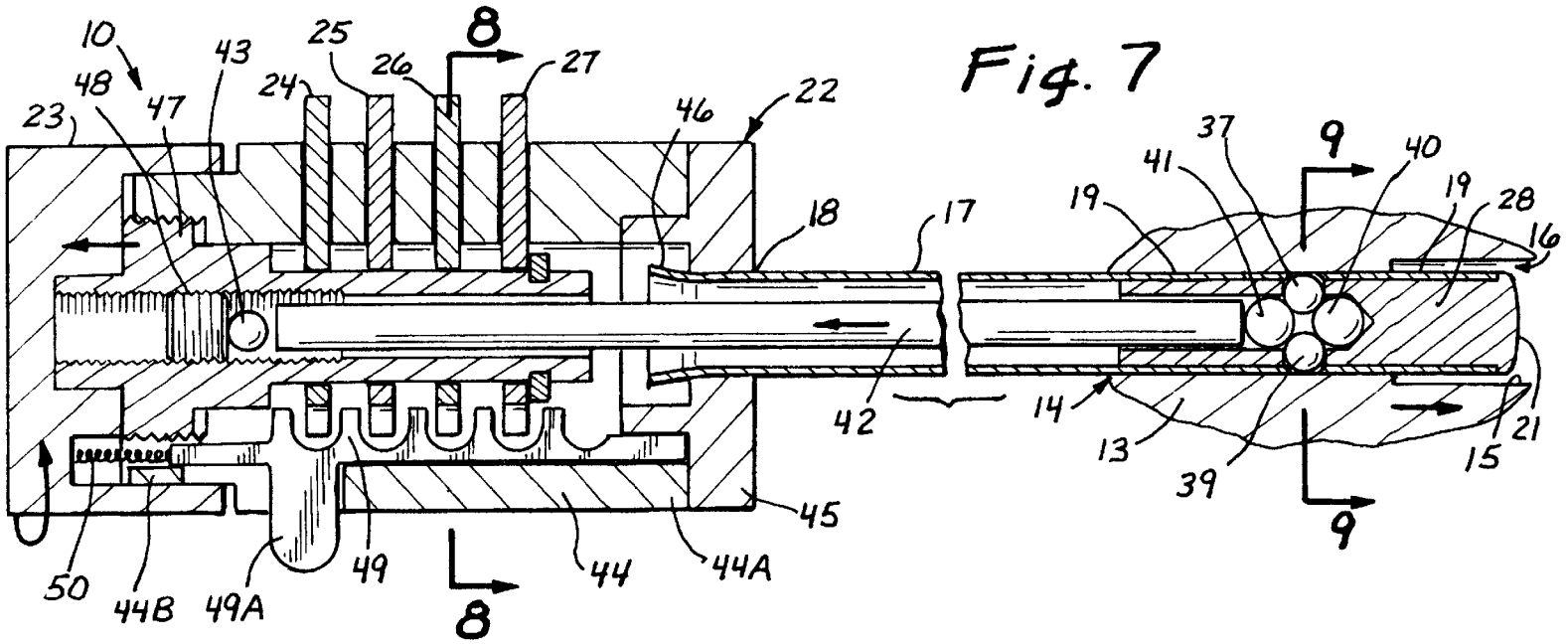
FIG. 7 is a cross sectional view similar to FIG. 4, except that the gun lock is in an unlocked configuration enabling withdrawal from the chamber and bore of the gun barrel.
Figure 9:
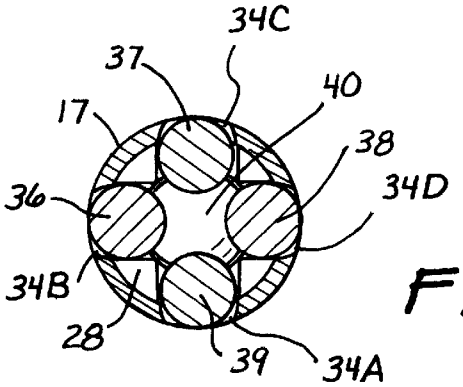
FIG. 9 is a cross section view of the locking balls taken on line 9—9 of FIG. 7 with the gun lock in the unlocked configuration.

Generally, the gun lock 10 includes a hollow tube 17 having a proximal end portion 18, a distal end portion 19, (FIGS. 1, 2, 4, and 7) and a length sufficient to extend within the bore 14 from the muzzle 12 to within the chamber 16 as illustrated in FIGS. 4 and 7. The tube 17 is composed of a rigid material (e.g., steel). It is adapted to fit coaxially within the bore 14 in the sense that its outside diameter is less than the diameter of the bore 14 so that the tube 17 can be inserted into the bore 14 from the muzzle 12, as depicted in FIG. 1, with the tube 17 and the bore 14 coaxially disposed about an axis 20 (FIG. 1). As a further idea of size, the illustrated tube 17 measures about 0.435 inches in diameter and about 5.5 inches in length in order to work with the illustrated .45 caliber handgun 11.

A first subassembly within the distal end portion 19 of the tube 17 (an expandable subassembly 21 designated in FIGS. 4 and 7) expands radially in response to user operation of a second subassembly connected to the proximal end portion 18 (an actuator subassembly 22 designated in FIGS. 1, 4, and 7) to selectively obstruct removal of the tube 17. The user unlocks and then rotates a knurled actuator knob 23 (FIGS. 1, 4, and 7) a partially turn from a first or unlock position of the actuator knob 23 shown in FIG. 7 to a second or locked position shown in FIG. 4, thereby causing the expandable subassembly 21 to expand or enlarge radially. To unlock the actuator knob 23, the user moves four combination disks 24, 25, 26, and 27 (FIGS. 1, 4, and 7) to a predetermined combination of disk positions as explained later on in this description.

Now consider the expandable subassembly 21 in further detail. It includes a cylindrically shaped ball plug 28 (FIGS. 3, 4, and 7) that fits coaxially within the distal end portion 19 of the tube 17. Preferably composed of metal and sized for a press fit suitable for gluing and/or other means for holding it in place within the distal end portion 19, the ball plug 28 defines a ball plug bore 29 that is illustrated in dashed lines in FIG. 3. The ball plug 28 also defines four, equal-size, circular ball plug apertures 30–33 arranged at equal intervals in a ring formation around the circumference of the ball plug 28 (e.g., 0.165-inch diameter apertures for the .45 caliber handgun 11). Only the ball plug apertures 30, 31, and 32 are visible in FIG. 3, but the fourth ball plug aperture 33 is diametrically opposite the aperture 31 and it is designated in FIG. 6.

The four ball plug apertures 30–33 so defined face radially outward and extend from the bore 29 to corresponding ones of four tube apertures 34A–34D in the distal end portion 19 of the tube 17. The distal end portion 19 defines four, equal-size, circular tube apertures 34A–34D arranged at equal intervals in a ring formation around the circumference of the distal end portion 19 (e.g., 0.150-inch diameter apertures for the .45 caliber handgun 11). Only the tube apertures 34A, 34B, and 34C are visible in FIG. 2, but the fourth tube aperture 34D is diametrically opposite the tube aperture 34B and it is designated in FIGS. 6 and 9 (aligned with the fourth ball plug aperture 33).

So configured, the ball plug 28 is adapted to hold four relatively smaller locking balls 36, 37, 38, and 39 that measure about 0.155 inches in diameter for the .45 caliber handgun 11 (FIGS. 4, 6, 7, and 9) and two relatively larger compression balls 40 and 41 that measure about 0.187-inches in diameter for the .45 caliber handgun 11 (FIGS. 4 and 7). The term "locking balls" is chosen simply to reflect the fact that the locking balls 36, 37, 38, and 39 serve to move radially outward and protrude through corresponding ones of the ball plug apertures 30–33 and tube apertures 34A–34B for locking purposes. The term "compression balls" is chosen simply to reflect the fact that the compression balls 40 and 41 serve to bear against the locking balls in order to cause the locking balls 36, 37, 38, and 39 to move radially outward.

The ball plug 28 is disposed coaxially in the distal end 19 of the tube 17 so that the each of the four ball plug apertures 30–33 is aligned with a corresponding one of the four tube apertures 34A–34D. There, the ball plug 28 holds the compression balls 40 and 41 in cooperating relationship with the four locking balls 36, 37, 38, and 39. The locking balls 36, 37, 38, and 39 are disposed in a ring so that each of the locking balls 36, 37, 38, and 39 is aligned with a corresponding one of the ball plug apertures 30–33 and a corresponding one of the tube apertures 34A–34D. The first compression ball 40 is disposed distally of and in contact with the ring of locking balls 36, 37, 38, and 39. The second compression ball 41 is disposed proximally of the ring of locking balls 36, 37, 38, and 39.

The ball plug apertures 30–33 align with the four tube apertures 34A–34D so that the locking balls 36, 37, 38, and 39 protrude through the four tube apertures 34A–34D and into contact with the chamber wall 15. When the compression balls 40 and 41 are forced together by axial movement of a rod 42 that is disposed coaxially within the tube 17 (FIGS. 4 and 7), the compression balls 40 and 41 cooperate in opposing relationship to force each of the locking balls 36, 37, 38, and 39 radially outward a small amount from a first or unlocked configuration illustrated in FIG. 9 to a second or locked configuration illustrated in FIG. 7. The rod 42 serves as a means for coupling axial movement from the actuator subassembly 22 to the expandable subassembly 21 (i.e., the second compression ball 41) when the actuator knob 23 is moved to the second position.

In the unlocked configuration, the locking balls are disposed radially inward enough to fit within the bore 14 so that they do not obstruct removal of the tube 17 from the bore 14. In the locked configuration, each of the locking balls 36, 37, 38, and 39 protrudes through a corresponding one of the four ball plug apertures 30-33 and an aligned one of the four tube apertures 34A–34D sufficiently to obstruct removal of the tube 17 from the bore 14.

Preferably, the locking balls 36, 37, 38, and 39 and the compression balls 40 and 41 are all spherical, ball bearing grade components in the sense that they are hard and smooth. Thus, they have what might call for the purposes of this description as a point contact with each other, with the chamber wall 15, with the rod 42, and with the ball plug 28. Such point contact coupled with the multiple ball arrangement minimizes frictional influence of one component over the other and leaves the balls free to rotate. Instead of marring the chamber wall 15, the locking balls rotate if someone rotates the gun lock 10 within the bore 14 of the barrel 13.

The compression balls 40 and 41 are also free to rotate. Even the rod 42 is free to rotate relative to the actuator subassembly 22 by virtue of a coupling ball 43 (FIGS. 4 and 7). The term "coupling ball" is chosen simply to reflect the coupling function of the coupling ball 43. When the gun lock 10 is transferred to the first or unlock configuration shown in FIG. 7, the compression balls 40 and 41 relax so that the locking balls 36, 37, 38, and 39 can move radially inward to the unlocked configuration in which the expandable subassembly 21 again fits within the bore 14 and does not obstruct removal of the tube 17 from the bore 14. Stated another way, the expandable subassembly 21 on the distal end portion 19 of the tube 17 is adapted to be moved under user control between a first configuration of the expandable subassembly 21 that fits within the bore 14 so that the expandable subassembly 21 does not obstruct removal of the tube 17 from the bore 14, and a second configuration of the expandable subassembly 21 that fits within the chamber 16 but does not fit within the bore 14 so that the expandable subassembly 21 does obstruct removal of the tube 17 from the bore 14.

Turning now to the actuator subassembly 22 shown FIGS. 4 and 7, it is connected to the proximal end 18 of the tube 17 where it serves the function of enabling a user to selectively move the expandable subassembly 21 between the first and second configurations while the tube 17 is within the bore 14. For that purpose, the actuator subassembly 22 includes a lock body 44 having a first end portion 44A and a second end portion 44B (FIGS. 4 and 7). The lock body may take any of various shapes within the inventive concepts disclosed, including the illustrated 1.375-inch diameter by 1.75-inch long cylindrically shaped steel body. The first end portion 44A of the lock body 44 is connected to the proximal end portion 18 of the tube 17 by a metal end cap 45 that is glued, bonded, or otherwise suitably attached to the first end portion 44A. A flare 46 on the proximal end portion 18 of the tube 17 (FIGS. 2, 4, and 7) helps prevent the tube from moving axially out of the end cap 45.

A threaded compression insert 47 operates in threaded engagement of the second end portion 44B of the lock body 44 so that rotating the threaded compression insert 47 transfers axial movement via the coupling ball 43 to the rod 42. The term "threaded compression insert" is chosen for this component simply to reflect the fact that it screws into the lock body 44 for purposes of imparting axial movement to the rod 42 and thereby to the second compression ball 41. The actuator knob 23 is mounted rotatably on the lock body 44 in the sense that it is glued, bonded, or otherwise suitably attached to the threaded compression insert 47.

Rotating the actuator knob 23 a partial turn from the first position illustrated in FIG. 7 to the second position illustrated in FIG. 4 causes the threaded compression insert 47 to rotate and advance axially toward the end cap 45. An adjustment screw 48 in threaded engagement with the threaded compression insert 47 transfers that axial movement to the coupling ball 43. The coupling ball 43 couples axial movement to the rod 42, and the rod 42 couples it to the compression ball 41. During fabrication of the gun lock 10, the adjustment screw 48 is glued or otherwise bonded in a desired position in the threaded compression insert so that operation of the actuator knob 23 causes the locking balls 36, 37, 38, and 39 to move radially outward just the right amount for the size of the chamber 16 in the handgun 11. Stated another way, the actuator knob 23 is adapted to be rotated manually a partial turn between a first position of the actuator knob 23 corresponding to the expandable subassembly 21 being in the first or unlocked configuration and a second position of the actuator knob 23 corresponding to the expandable subassembly 21 being in the second or locked configuration.

The actuator subassembly 22 also includes means for locking the actuator knob 23 in the second position in order to lock the tube 17 in the bore 14 of the handgun 11. That is accomplished with a combination lock built into the lock body 44. The combination lock includes the disks 24, 25, 26, and 27 that work in cooperation with a locking bar 49 (FIGS. 4, 5, 7 and 8). Each of the disks is rotatable, no more than a partial turn, between six disk positions. When the disks 24, 25, 26, and 27 are set in the predetermined combination of disk positions for the four disks, the locking bar 49 is free to move axially between the first or unlocked locking bar position shown in FIG. 7 and the second or locked locking bar position shown in FIG. 4.

In the second or locked locking bar position shown in FIG. 4, a locking bar tab 49A on the locking bar 49 engages the actuator knob 23 so that the actuator knob 23 can not be rotated. With the disks 24, 25, 26, and 27 in the predetermined combination of disk positions, the user bears against the locking bar tab 49A to move the locking bar 49 to that position. Then, the user rotates the disks 24, 25, 26, and 27 out of the predetermined combination of disk positions. Doing so locks the locking bar 49 in the second position and that locks the actuator knob 23 from being rotated.

Moving the disks 24, 25, 26, and 27 back to the predetermined combination of disk positions frees the locking bar 49 so that a small spring 50 (FIG. 7) can automatically move the locking bar to the first or unlocked locking bar position shown in FIG. 7. That frees the actuator knob 23 so that it can be rotated in order to move the threaded compression insert 47 axially away from the second compression ball 41. Moving the disks 24, 25, 26, and 27 out of the predetermined combination of disk positions then locks the locking bar 49 in the first or unlocked locking bar position.

Figure 5:
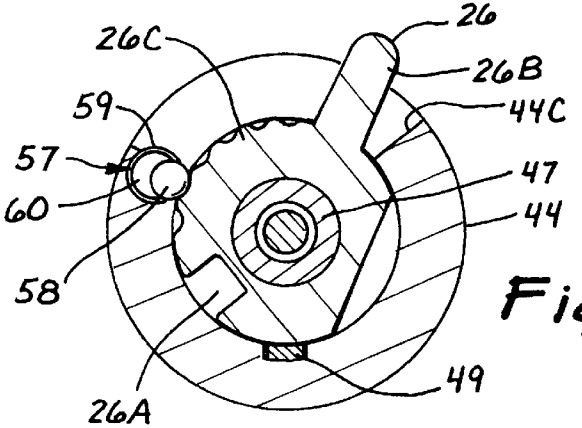
FIG. 5 is a cross sectional view of one of the combination disks of the gun lock, taken on line 5—5 of FIG. 4 with the gun lock in the locked configuration.
Figure 8:
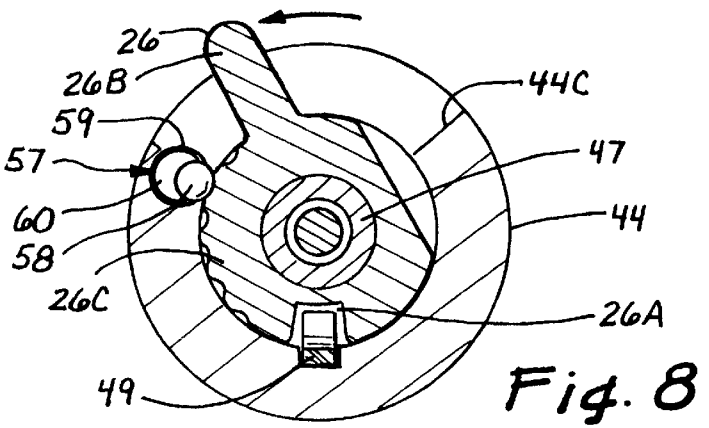
FIG. 8 is a cross sectional view taken on line 8—8 of FIG. 7 of the same combination disk shown in FIG. 5, but with the gun lock in the unlocked configuration.
Figure 10:
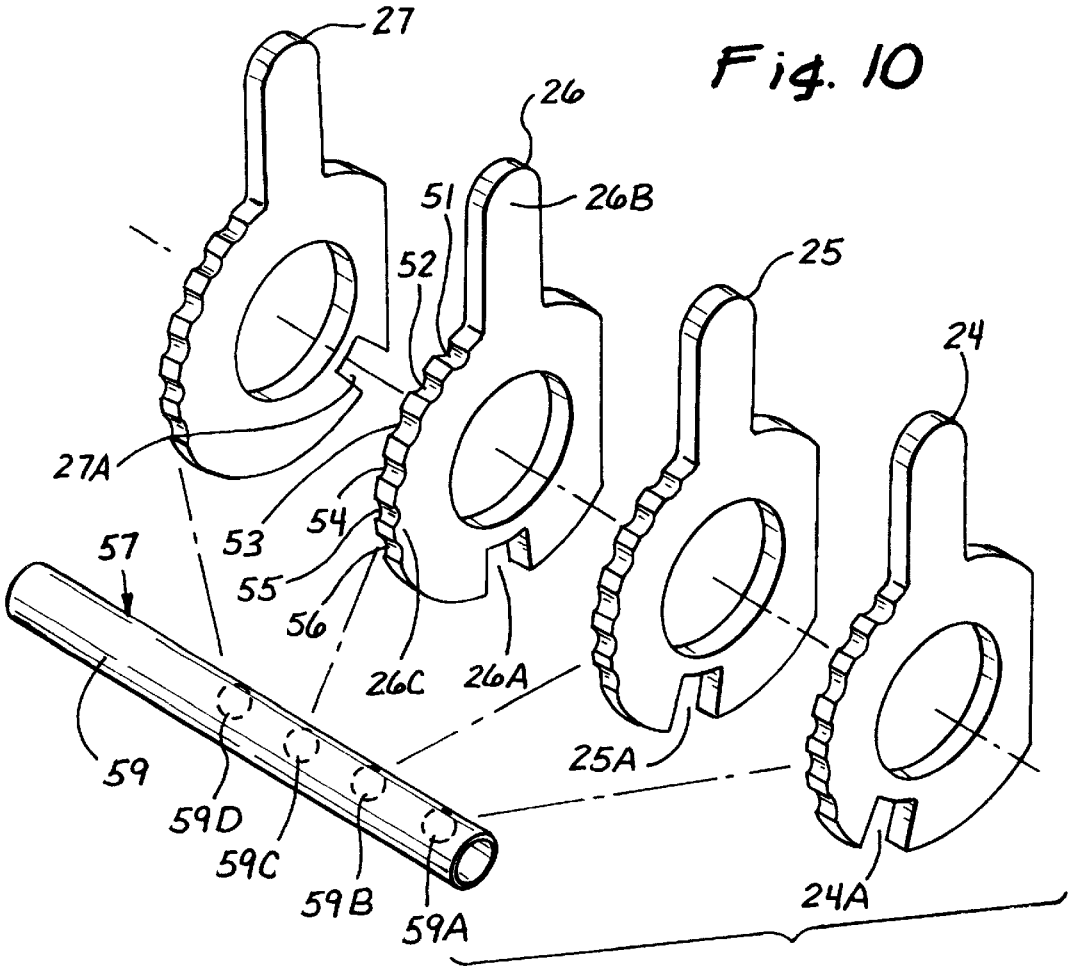
FIG. 10 is a further enlarged, disassembled view of the four combination disks and the associated detent arrangement.

Operation of each of the disks 24, 25, 26, and 27 is similar and so operation of only the disk 26 is illustrated in FIGS. 5 and 8. The disk 26 defines a locking bar slot 26A and it includes a tab portion 26B. The tab portion 26B protrudes radially outward from the rest of the disk where it helps indicate disk position. It also serves as a structure for a user to bear against in order to rotate the disk 26 between disk positions. By bearing against the tab 26B, the user can rotate the disk 26 to any of six different disk positions in order to selectively align the locking bar slot 26A with the locking bar 49. With the disk 26 in the fifth disk position shown in FIG. 5, the locking bar slot 26A is not aligned with the locking bar 49 and so the disk obstructs axial movement of the locking bar 49. With the disk 26 in the second disk position shown in FIG. 8, the locking bar slot 26A is aligned with the locking bar 49 and so the disk 26 does not obstruct axial movement of the locking bar 49.

The disk 26 has an outer periphery portion 26C (FIGS. 5, 8, and 10) that defines six recesses 51–56 (FIG. 10) corresponding to an equivalent number of six disk positions. Adjacent ones of the recesses 51–56 are spaced apart center-to-center by about 16–17 degrees of arc. A detent arrangement 57 (FIGS. 5, 8, and 10) cooperates with the recesses 51–56 to partially restrain the disks 24, 25, 26, and 27 at each disk position while providing tactile feedback to the user of movement between disk positions in order to facilitate operation in darkness (i.e., facilitate user movement of the disks to desired disk positions without the user having to visually determine disk position). The disks 24, 25, and 27 re similar to the disk 26 except that the location of the locking bar slots 24A, 25A, and 27A are different in order to set a predetermined combination of different disk positions that must be used to unlock the combination lock. The term "tactile feedback" is chosen to reflect the fact that the user can feel operation of the detent arrangement 57 as it passes the recesses 51–56.

Concerning the detent arrangement 57, it includes a detent ball 58 that is held within a ball tube 59 by a rubber ball tube spring 60 (FIGS. 5 and 8). The rubber ball tube spring 60 is a length of rubber or other resiliently deformable material that fits within the ball tube 57 where it bears against the detent ball 58 in order to spring bias the detent ball 58 outwardly toward the disk 26. The detent arrangement 57 includes a similar detent ball for each of the other disks 24, 25, and 27 (not shown) and the ball tube 59 defines four ball tube apertures 59A, 59B, 59C, and 59D (FIG. 10) through which the detent balls protrude to contact the outer periphery portion of the disks 24, 25, 26, and 27. The user can feel the recesses pass by the detent balls. By counting the number of recesses that pass a detent ball, the user can move each disk to a desired disk position by feel, without viewing the disk.

The ball tube 59 and a shoulder portion 44C of the lock body 44 (FIGS. 5 and 8) restrict rotational movement of the disk 26 to a partial turn (about 100 degrees of arc) between a first stop position where the tab 26B abuts the ball tube 59 and a second stop position where it abuts the shoulder portion 44C. To move the disk 26 to a desired disk position without viewing the disk 26, the user moves the disk 26 until it abuts the ball tube 59 (i.e., the first stop position) or until it abuts the shoulder portion 44 (i.e., the second stop position). From that stop position as a starting position, the user counts the number of recesses that pass the detent ball 58 until the disk 26 is moved to the desired disk position. When the detent ball 58 passes into one of the recesses 51–56, it provides tactile feedback in the form of a user discernible vibration or "click." The user counts the clicks to determine disk position. Rotational movement of the disks 24, 25, and 27 are restricted in a similar way, and the user rotates them to a desired disk position in a similar manner.

Typically, the user sets the position of disk 26 by first moving the disk 26 to the first stop position where it abuts the ball tube 59. Then the user rotates the disk 26 while noticing and counting each click as the detent ball 58 passes the recesses 51–56. The first click occurs as the detent ball 58 moves into the first recess 51. The second click occurs as the detent ball 58 moves into the second recess 52. The third click occurs as the detent ball 58 moves into the third recess 53. The fourth, fifth, and sixth clicks occur as the detent ball 58 moves progressively into the fourth, fifth, and sixth recesses 54, 55, and 56. After counting a desired number of clicks, the user stops rotating the disk 26 so that it remains at a desired disk position. This procedure is performed for each of the disks 24, 25, 26, and 27 in order to set the disks in the predetermined combination of disk positions.

Figure 11:
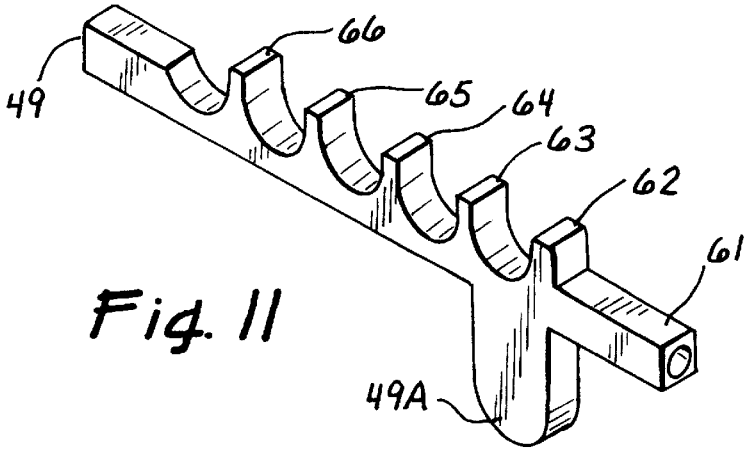
FIG. 11 is an enlarged view of just the locking bar component.

Concerning the locking bar 49, it includes a protruding portion 61 shown in FIG. 11 that contacts the spring 50 shown in FIG. 7. When one or more of the disks 24, 25, 26, and 27 are not in the predetermined combination of disk positions, those one or more disks obstruct movement of the locking bar 49 by contacting corresponding ones of upstanding fingers 62–66 (FIG. 11). When the disks 24, 25, 26, and 27 are moved to the predetermined combination of disk positions so that they do not obstruct movement of the locking bar 49, the spring 50 automatically moves the locking bar 49 distally so that it no longer engages the actuator knob 23.

Ease of assembly during fabrication is an added feature of the gun lock 10. After attaching the ball plug 28 to the distal end portion 19 of the tube 17, and the proximal end portion 18 of the tube 17 to the end cap 45, the detent arrangement 57 is placed within the lock body 44 and the end cap 45 is attached to the first end portion 44A of the lock body 44.

Assembly proceeds by placing the tube 17 in a vertical position with the distal end portion 18 disposed downwardly. The first compression ball 40 is then dropped through the lock body 44 into the tube 17 and allowed to settle into the ball plug bore 29. Next, the four locking balls 36, 37, 38, and 39 are dropped through the lock body 44 and the tube 17 into the ball plug bore 29, followed by the second compression ball 41.

The four disks 24, 25, 26, and 27 and the locking bar 49 are then placed within the lock body 44. Next, the rod 42 is added. Then, with the adjustment screw 48 already screwed into the threaded compression insert 47, the coupling ball 43 is placed into the threaded compression insert 47. The tube 17 is shifted in position so that it is more horizontally disposed, and then the threaded compression insert 47 is screwed into the second end portion 44B of the lock body 44 so that the coupling ball 43 contacts the rod 42. The adjustment screw 48 is then rotated to adjust it in axially position so that the four locking balls 36, 37, 38, and 39 protrude radially a desired amount. The adjustment screw 48 is bonded in place, after which the actuator knob 23 is bonded onto the threaded compression insert 47.

Thus, the invention provides a locking device of the barrel lock type that includes a better chamber-engaging arrangement and a better combination lock arrangement. Four user-controlled locking balls move radially outward to the chamber wall while remaining free to rotate so that the gun lock can swivel without damaging the chamber. Multiple-position combination disks are coupled with a peripheral detent arrangement that enables dialing in the combination by feel without viewing the combination disks. The locking balls are deployed radially outward to a locked configuration chamber wall without spring action so that there is no spring component to eventually fail. The amount of deployment can be precisely preset for a particular gun with an integral adjustment screw. The ergonomics of four combination disks and their limited-positions, coupled with the peripheral detent arrangement, provide just the right feel for quick, trouble-free, touch-code operation by an authorized user, even in total darkness.

Based upon the foregoing, one of ordinary skill in the art can readily practice the invention. Although exemplary embodiments have been shown and described, one of ordinary skill in the art may make many changes, modifications, and substitutions without necessarily departing from the spirit and scope of the invention.

What is claimed is:

1. A locking device in combination with a firearm having a barrel with a muzzle, a bore in the barrel with a first diameter, and a chamber wall that defines a chamber with a second diameter larger than the first diameter, the combination comprising:

a hollow tube adapted to fit coaxially within the bore, the tube having a proximal end portion, a distal end portion, and a length sufficient to extend from the muzzle to the chamber;

a first subassembly on the distal end portion of the tube that is adapted to be moved under user control between a first configuration of the first subassembly that fits within the bore so that the first subassembly does not obstruct removal of the tube from the bore, and a second configuration of the first subassembly that fits within the chamber but does not fit within the bore so that the first subassembly does obstruct removal of the tube from the bore;

a second subassembly connected to the proximal end of the tube for enabling a user to selectively move the first subassembly between the first and second configurations while the tube is within the bore, the second subassembly including an actuator knob adapted to be rotated manually a partial turn between a first position of the actuator knob corresponding to the first subassembly being in the first configuration and a second position of the actuator knob corresponding to the first subassembly being in the second configuration, and the second subassembly including means for locking the actuator knob in the second position; and a rod disposed coaxially within the tube to serve as means for coupling axial movement from the second subassembly to the first subassembly when the actuator knob is rotated to the second position;

the distal end portion of the tube defining first, second, third, and fourth apertures disposed in a ring formation at circumferentially spaced apart locations around a periphery of the distal end portion;

the first subassembly including first, second, third, and fourth radially moveable balls disposed in a ring formation within the distal end portion of the tube, said first subassembly adapted to hold each of the radially moveable balls in alignment with an associated one of the first, second, third, and fourth apertures so that the radially moveable balls are free to rotate and to be moved radially;

the first subassembly including first and second compression balls within the distal end portion of the tube, the first compression ball located distally of the radially moveable balls, the second compression ball located proximally of the radially moveable balls, both the first and second compression balls free to rotate, and the first and second compression balls adapted to bear against and move the radially moveable balls radially outward when the second compression ball is moved axially toward the first compression ball;

the second subassembly so adapted that moving the actuator knob from the first position to the second position with the tube in the bore causes the rod to bear against and move the second compression ball axially toward the first compression ball, thereby causing the radially moveable balls to protrude through the first, second, third, and fourth apertures to the chamber wall to obstruct removal of the tube from the bore; and the second subassembly so adapted that moving the actuator knob from the second position to the first position causes the rod to retract from the second compression ball so that the radially moveable balls are free to move radially inward sufficiently to not obstruct removal of the tube from the bore.

2. A locking device in combination with a firearm as recited in claim 1, further comprising a coupling ball disposed between a proximal end of the rod and the second subassembly, which ball is free to rotate so that it couples axial movement between the rod and the second subassembly without coupling rotational movement.

3. A locking device in combination with a firearm as recited in claim 1, wherein the means for locking the actuator knob in the second position includes:

a lock body on which the actuator knob is mounted, which lock body is connected to the proximal end of the tube;

a locking bar on the lock body that is adapted to be moved by a user between an unlocked position of the locking bar in which the locking bar does not obstruct rotation of the actuator knob on the second subassembly and a locked position of the locking bar in which the locking bar does obstruct rotation of the actuator knob;

a plurality of disks on the lock body that are adapted to be manually rotated only a partial turn, each of the disks defining a slot such that the slots of all the disks must be aligned by rotating the disks to a predetermined combination of disk positions for the locking bar to be moved between the unlocked and locked positions; and a detent arrangement on the lock body for partially restraining the disks at each disk position;

each disk including a tab portion that protrudes radially outward from the rest of the disk as an indication of disk position and as a structure for a user to bear against to rotate the disk between disk positions;

each disk including an outer periphery portion that defines a fixed number of recesses corresponding to an equivalent number of disk positions; and the detent arrangement being adapted to cooperate with the recesses in the outer periphery portion of each disk in order to partially restrain the disks at each disk position while providing tactile feedback to the user of the movement between disk positions to facilitate operation in darkness.

4. A locking device in combination with a firearm as recited in claim 3, wherein the plurality of disks includes four disks and each disk is adapted to be moved among six disk positions.

5. A locking device in combination with a firearm having a barrel with a muzzle, a bore in the barrel with a first diameter, and a chamber wall that defines a chamber with a second diameter larger than the first diameter, the combination comprising:

a hollow tube adapted to fit coaxially within the bore, the tube having a proximal end portion, a distal end portion, and a length sufficient to extend from the muzzle to the chamber;

a first subassembly on the distal end portion of the tube that is adapted to be moved under user control between a first configuration of the first subassembly that fits within the bore so that the first subassembly does not obstruct removal of the tube from the bore, and a second configuration of the first subassembly that fits within the chamber but does not fit within the bore so that the first subassembly does obstruct removal of the tube from the bore;

a second subassembly connected to the proximal end of the tube for enabling a user to selectively move the first subassembly between the first and second configurations while the tube is within the bore, the second subassembly including an actuator knob adapted to be rotated manually a partial turn between a first position of the actuator knob corresponding to the first subassembly being in the first configuration and a second position of the actuator knob corresponding to the first subassembly being in the second configuration, and the second subassembly including means for selectively locking the actuator knob in the second position; and a rod disposed coaxially within the tube to serve as means for coupling axial movement from the second subassembly to the first subassembly when the actuator knob is rotated to the second position;

the means for selectively locking the actuator knob in the second position including (i) a lock body on which the actuator knob is mounted, which lock body is connected to the proximal end of the tube, (ii) a locking bar on the lock body that is adapted to be moved by a user between an unlocked position of the locking bar in which the locking bar does not obstruct rotation of the knob on the second subassembly and a locked position of the locking bar in which the locking bar does obstruct rotation of the knob, (iii) a plurality of disks on the lock body that are adapted to be manually rotated only a partial turn, each of the disks defining a slot such that the slots of all the disks must be aligned by rotating the disks to a predetermined combination of disk positions for the locking bar to be moved between the unlocked and locked positions, and (iv) a detent arrangement on the lock body for partially restraining the disks at each disk position;

each disk including a tab portion that protrudes radially outward from the rest of the disk as an indication of disk position and as a structure for a user to bear against to rotate the disk between disk positions;

each disk including an outer periphery portion that defines a fixed number of recesses corresponding to an equivalent number of disk positions; and the detent arrangement being adapted to cooperate with the recesses in the outer periphery portion of each disk to partially restrain the disks at each disk position while providing tactile feedback to the user of movement between disk positions to facilitate operation in darkness.

6. A locking device in combination with a firearm as recited in claim 5, wherein the plurality of disks includes four disks and each disk is adapted to be moved among six disk positions.

7. A locking device in combination with a firearm as recited in claim 5, wherein:

the distal end portion of the tube defining first, second, third, and fourth apertures disposed in a ring formation at circumferentially spaced apart locations around a periphery of the distal end portion;

the first subassembly includes first, second, third, and fourth radially moveable balls disposed in a ring formation within the distal end portion of the tube, said first subassembly adapted to hold each of the radially moveable balls in alignment with an associated one of the first, second, third, and fourth apertures so that the radially moveable balls are free to rotate and to be moved radially;

the first subassembly includes first and second compression balls within the distal end portion of the tube, the first compression ball located distally of the radially moveable balls, the second compression ball located proximally of the radially moveable balls, both the first and second compression balls free to rotate, and the first and second compression balls adapted to bear against and move the radially moveable balls radially outward when the second compression ball is moved axially toward the first compression ball, the second subassembly so adapted that moving the actuator knob from the first position to the second position with the tube in the bore causes the rod to bear against and move the second compression ball axially toward the first compression ball, thereby causing the radially moveable balls to protrude through the first, second, third, and fourth apertures to the chamber wall in order to obstruct removal of the tube from the bore; and the second subassembly so adapted that moving the actuator knob from the second position to the first position causes the rod to retract from the second compression ball so that the radially moveable balls are free to move radially inward sufficiently to not obstruct removal of the tube from the bore.

8. A locking device in combination with a firearm as recited in claim 7, further comprising a coupling ball disposed between a proximal end of the rod and the second subassembly, which ball is free to rotate so that it couples axial movement between the rod and the second subassembly without coupling rotational movement.

9. A locking device for a firearm having a barrel with associated bore having a first diameter extending along the barrel length from a muzzle to a chamber having a second diameter greater than the first diameter, the locking device comprising:

a tube with a diameter less than said first diameter, the tube having a proximal end portion, a distal end portion, and a length greater than or equal to said barrel length, the distal end portion of the tube having a plurality of apertures spaced circumferentially around a periphery of the distal end portion;

a first subassembly on the distal end portion of the tube selectively moveable between a first configuration in which the first subassembly has a diameter less than said first diameter, and a second configuration in which the first subassembly has a diameter greater than said first diameter and less than or equal to said second diameter, the first subassembly comprising:

a plurality of radially moveable balls equal to the number of apertures, the radially moveable balls disposed in a ring formation within the distal end portion of the tube, each radially moveable ball in alignment with an associated aperture; and first and second compression balls in the distal end portion of the tube, the first and second compression balls located on opposite sides of said radially moveable balls, the first and second compression balls positioned with respect to said radially moveable balls to drive the radially moveable balls radially outward when the second compression ball is moved axially toward the first compression ball; and a second subassembly connected to the proximal end portion of the tube, the second subassembly coupled to said First subassembly to transmit motion from the second subassembly to the first subassembly, the second subassembly comprising:

an actuator selectively moveable between a first position corresponding to the first subassembly being in said second configuration in which the actuator causes the first and second compression balls to converge axially to drive the radially moveable balls to protrude through the apertures to extend the first subassembly diameter to greater than said first diameter and less than or equal to said second diameter, and a second position corresponding to the first subassembly being in said first configuration in which the second compression ball separates from the first compression ball, thereby permitting the radially moveable balls to move radially inward to reduce the first subassembly diameter to less than said first diameter; and a lock to secure the actuator in said second position.

10. The locking device of claim 9, further comprising:

a rod disposed coaxially within the tube to couple axial movement from the second subassembly to the first subassembly when the actuator is rotated to the second position; and a coupling ball disposed between a proximal end of the rod and the second subassembly, said ball free to rotate to couple axial movement between the rod and the second subassembly without coupling rotational movement.

11. The locking device of claim 9, wherein the lock comprises:

a lock body on which the actuator is mounted, said lock body connected to the proximal end portion of the tube, said lock body including a detent arrangement thereon;

a locking bar on the lock body that is adapted to be moved by a user between an unlocked position of the locking bar in which the locking bar does not obstruct rotation of the actuator on the second subassembly and a locked position of the locking bar in which the locking bar does obstruct rotation of the actuator; and a plurality of manually rotatable disks on the lock body, each of the disks defining a slot such that the slots of all the disks must be aligned by rotating the disks to a predetermined combination of disk positions for the locking bar to be moved between the unlocked and locked positions, each disk including an outer periphery portion that having a fixed number of recesses corresponding to an equivalent number of disk positions, said recesses cooperating with said detent arrangement to partially restrain the disks at each disk position and provide tactile feedback to the user of the movement between disk positions to facilitate operation in darkness.

12. The locking device of claim 11, wherein the plurality of disks includes four disks and each disk is adapted to be moved among six disk positions.

13. A locking device for a firearm having a barrel with associated bore having a first diameter extending along the barrel length from a muzzle to a chamber having a second diameter greater than the first diameter, the locking device comprising:

a tube with a diameter less than said first diameter, the tube having a proximal end portion, a distal end portion, and a length greater than or equal to said barrel length;

a first subassembly on the distal end portion of the tube selectively moveable between a first configuration in which the first subassembly has a diameter less than said first diameter, and a second configuration in which the first subassembly has a diameter greater than said first diameter and less than or equal to said second diameter; and a second subassembly connected to the proximal end portion of the tube, the second subassembly coupled to said first subassembly to transmit motion from the second subassembly to the first subassembly, the second subassembly comprising:

an actuator selectively moveable between a first position corresponding to the first subassembly being in the first configuration, and a second position corresponding to the first subassembly being in the second configuration; and a lock to secure the actuator in said second position, said lock including (i) a lock body on which the actuator is mounted, said lock body connected to the proximal end portion of the tube, said lock body including a detent arrangement thereon, (ii) a locking bar on the lock body that is adapted to be moved by a user between an unlocked position of the locking bar in which the locking bar does not obstruct rotation of the actuator on the second subassembly and a locked position of the locking bar in which the locking bar does obstruct rotation of the actuator, and (iii) a plurality of manually rotatable disks on the lock body, each of the disks defining a slot such that the slots of all the disks must be aligned by rotating the disks to a predetermined combination of disk positions for the locking bar to be moved between the unlocked and locked positions, each disk including an outer periphery portion that having a fixed number of recesses corresponding to an equivalent number of disk positions, said recesses cooperating with said detent arrangement to partially restrain the disks at each disk position and provide tactile feedback to the user of the movement between disk positions to facilitate operation in darkness.

14. The locking device of claim 13, wherein the plurality of disks includes four disks and each disk is adapted to be moved between six disk positions.

15. The locking device of claim 13, wherein:

the distal end portion of the tube further comprises a plurality of apertures spaced circumferentially around a periphery of the distal end portion; and the first subassembly further comprises:

a plurality of radially moveable balls equal to the number of apertures, the radially moveable balls disposed in a ring formation within the distal end portion of the tube, each radially moveable ball in alignment with an associated aperture; and first and second compression balls in the distal end portion of the tube, the first and second compression balls located on opposite sides of said radially moveable balls, the first and second compression balls positioned with respect to said radially moveable balls to drive the radially moveable balls radially outward when the second compression ball is moved axially toward the first compression ball, such that when the actuator is moved to said second position, the actuator causes the first and second compression balls to converge axially to drive the radially moveable balls to protrude through the apertures to extend the first subassembly diameter to greater than said first diameter and less than or equal to said second diameter, and when said actuator is moved to said first position, the actuator causes the second compression ball to separate from the first compression ball, thereby permitting the radially moveable balls to move radially inward to reduce the first subassembly diameter to less than said first diameter.

16. The locking device of claim 15, further comprising:

a rod disposed coaxially within the tube to couple axial movement from the second subassembly to the first subassembly when the actuator is rotated to the first position; and a coupling ball disposed between a proximal end of the rod and the second subassembly, said ball free to rotate to couple axial movement between the rod and the second subassembly without coupling rotational movement.

* * * * *

UNITED STATES PATENT AND TRADEMARK OFFICE

CERTIFICATE OF CORRECTION

PATENT NO. : 6,560,910 B1
DATED : May 13, 2003
INVENTOR(S) : McLaren, Robert R.

It is certified that error appears in the above-identified patent and that said Letters Patent is hereby corrected as shown below:

Title page,
Item [76], Inventors, please delete "Betterline Products, Inc., P.O. Box 3842, Fullerton, CA (US) 92834-3842" and insert therefor -- 3150 Soft Breezes Dr. #1218, Las Vegas, NV (US) 89128 --.

Signed and Sealed this

Twenty-sixth Day of August, 2003

JAMES E. ROGAN
*Director of the United States Patent and Trademark Office*